US009206581B2

(12) United States Patent
Mollick et al.

(10) Patent No.: US 9,206,581 B2
(45) Date of Patent: Dec. 8, 2015

(54) MODULAR AND RECONFIGURABLE PLAYGROUND SUPPORT STRUCTURE

(76) Inventors: Jonathan David Mollick, Juneau, AK (US); Kevin Joseph Brady, Huntington, WV (US)

( * ) Notice: Subject to any disclaimer, the term of this patent is extended or adjusted under 35 U.S.C. 154(b) by 0 days.

(21) Appl. No.: 13/345,533

(22) Filed: Jan. 6, 2012

(65) Prior Publication Data

US 2012/0174510 A1 Jul. 12, 2012

Related U.S. Application Data

(60) Provisional application No. 61/430,753, filed on Jan. 7, 2011.

(51) Int. Cl.

| | |
|---|---|
| ***E02D 27/32*** | (2006.01) |
| ***A63B 9/00*** | (2006.01) |
| ***A63B 17/04*** | (2006.01) |
| ***A63G 31/00*** | (2006.01) |

(52) U.S. Cl.

CPC ..... *E02D 27/32* (2013.01); *A63B 17/04* (2013.01); *A63G 31/00* (2013.01); *A63B 2009/006* (2013.01)

(58) Field of Classification Search

CPC ..... E04F 11/1812; A63B 1/00; A63B 3/00; A63B 9/00; A63B 17/00; A63B 17/02; A63B 17/04; A63B 2009/00; A63B 2009/04; A63B 2009/006; A63B 2009/008; E02D 27/32; A63G 31/00; A63G 21/00

USPC ..... 52/79.1, 292, 298, 403.1, 650.3, 169.9; 482/35, 36; D21/814, 826; 446/1, 92, 446/118

See application file for complete search history.

(56) References Cited

U.S. PATENT DOCUMENTS

| | | | | | |
|---|---|---|---|---|---|
| 1,935,542 | A | * | 11/1933 | Bursell | 446/110 |
| 2,871,619 | A | * | 2/1959 | Walters | 446/110 |
| 3,561,757 | A | | 2/1971 | Schillig | |
| 3,955,328 | A | | 5/1976 | Lindsay | |
| 4,964,802 | A | * | 10/1990 | Weller | 434/96 |
| 5,096,188 | A | * | 3/1992 | Shen | 482/51 |
| 5,428,935 | A | * | 7/1995 | Mitchell | 52/698 |
| 5,452,896 | A | * | 9/1995 | Core | 473/164 |
| 5,496,232 | A | * | 3/1996 | Morris et al. | 482/35 |
| 5,713,175 | A | * | 2/1998 | Mitchell | 52/582.1 |
| 5,924,960 | A | * | 7/1999 | Cohen | 482/51 |

(Continued)

*Primary Examiner* — Ryan Kwiecinski

(74) *Attorney, Agent, or Firm* — Daniel Boudwin; Global Intellectual Property Agency LLC

(57) ABSTRACT

A modular grid structure and method of construction for a playground, wherein the position of playground modules is easily established and rearranged within a array of securement locations and in relation to surrounding modules. The grid comprises a permanent or temporary foundation having a plurality of playground module support locations aligned in a grid or array, such that the playground may be constructed by placing the support posts of the module in connection with the foundation support locations. The disclosed support locations comprise embodiments that permanently secure the posts of a playground module using a pin-locking support hole, or alternatively a temporarily support means to movement for a shorter period while allowing swift setup and breakdown of the entire assembly, such as for temporary playgrounds.

15 Claims, 4 Drawing Sheets

(56) References Cited

U.S. PATENT DOCUMENTS

| | | | | |
|---|---|---|---|---|
| 6,151,853 | A * | 11/2000 | Fukunaga | 52/264 |
| 7,060,002 | B1 * | 6/2006 | Boehme | 482/35 |
| 7,229,334 | B2 * | 6/2007 | Ishikawa | 446/91 |
| 7,316,237 | B2 * | 1/2008 | Connelly | 135/117 |
| 7,472,666 | B1 * | 1/2009 | Richard et al. | 114/361 |
| 2004/0118056 | A1 * | 6/2004 | Peters et al. | 52/79.1 |
| 2004/0211126 | A1 * | 10/2004 | Allen | 52/27 |
| 2004/0226594 | A1 * | 11/2004 | Connelly et al. | 135/117 |
| 2005/0072115 | A1 * | 4/2005 | Chappell et al. | 52/782.1 |
| 2006/0276100 | A1 * | 12/2006 | Glickman | 446/118 |
| 2007/0087154 | A1 * | 4/2007 | Bird et al. | 428/44 |
| 2008/0305708 | A1 * | 12/2008 | Toht et al. | 446/92 |
| 2009/0093182 | A1 * | 4/2009 | Jacobs et al. | 446/120 |
| 2010/0304935 | A1 * | 12/2010 | Todokoro | 482/35 |
| 2012/0071252 | A1 * | 3/2012 | Georg et al. | 472/92 |
| 2012/0316038 | A1 * | 12/2012 | Beckwith et al. | 482/35 |
| 2013/0324382 | A1 * | 12/2013 | Wilson | 482/142 |

* cited by examiner

MODULAR AND RECONFIGURABLE PLAYGROUND SUPPORT STRUCTURE

CROSS REFERENCE TO RELATED APPLICATION

This application claims the benefit of U.S. Provisional Application No. 61/430,753 filed on Jan. 7, 2011, entitled "Movnplay."

BACKGROUND OF THE INVENTION

1. Field of the Invention

The present invention relates to playground architecture and methods of construction. More specifically, the present invention pertains to a modular and reconfigurable playground support structure having a plurality of support locations to position various structures and playground modules into a grid format. The associated method entails providing a playground construction grid using predefined and known support locations for contractors or assemblers to plan a playground layout. The method further includes providing a modular and modifiable playground layout using a grid foundation for users to modify, rearrange or replace playground modules for short-term or long-term playground parks.

2. Description of the Prior Art

Construction of permanent structures typically involves creation of in-ground foundations that provide footings for each load bearing member of the structure being erected. This involves careful planning and detailed design of the foundation layout, and breaking ground to locate footings at specific points. For playground parks, this generally entails the permanent placement of swing sets, slides and other playground structures in a given location, wherein the footings of these structures are cemented or otherwise secured in a static position within the ground for permanent placement. Once installed, the supports of the structures cannot be moved unless dug up from their foundation and moved through excavation. This type of construction and later excavation involves heavy equipment, labor intensive activities and considerable time and effort in the planning stage and the construction stage of the project. The assemblies are incapable of adapting to changing attitudes and preferences of those users, wherein modification of the playground would consume considerable time and expense.

While this method of construction is effective for one-off and long-term playground structures, there exists a need in the art for a more flexible playground architecture and one that allows playground modules to be replaceable and reconfigurable to meet the changing needs of a user. The present invention pertains to a new type of playground structure and means of construction. Specifically, the present invention provides a grid foundation having a plurality of support locations for playground structural footings, wherein the footings may be aligned with the support locations in any orientation to create a unique layout and one that is modifiable without laborious excavation. Modules can be positioned in neighboring footings to create an entire playground assembly of modules positioned as desired by the user. The support locations are universal, as well as the playground module footings, to allow any such structure to be positioned anywhere on the foundation in a predictable and easily designed architecture. The support locations provide fungible connectivity that allows the modules to be repositioned, reconfigured and modular with respect to the foundation to adapt to a specific user or community need. The foundation is provided in two forms: a short-term and long-term form, wherein the elements of the foundation grid support locations differ between the type of construction desired. Short-term playground parks that are assembled on-demand, as well as permanent playground locations for long-term use are both accommodated by the present invention and method.

Devices have been disclosed in the prior art for modular construction assemblies, but none describe a modular playground architecture or means of construction having the same elements or fulfilling the same need in the art as the present invention provides. The devices in the art provide building systems and playground assemblies that contain modular features. While providing a novel means to fulfill a respective requirement, the disclosed prior art fails to address the need for providing a temporary or long-term playground solution that affords particular modularity and reconfigurability that a community or user may demand, wherein the playground itself can be updated and rearranged to meet a given need.

One such device is U.S. Pat. No. 3,955,328 to Lindsay, which discloses a modular building system comprising connectable modules that provides an expandable internal habitation. Individual rooms and extra space is provided by each added module, which are interconnected with one another, providing a plurality of configurable floor plan arrangements. The Lindsay device, while describing a modular form of architecture, does not disclose a modular playground foundation for which to place structures and playground devices throughout using a removable post and sleeve configuration. The Lindsay device is more adapted to providing a modular living structure by way of interconnected habitats that provide shelter from the environment.

Further disclosed is U.S. Pat. No. 3,561,757 to Schillig, describing a modular playground block system, wherein each block is hingedly connected to another block module. The hinges allow the modules to rotate with respect to one another and reposition according to a user's desire. Through the modules are open spaces that create passageways or ports, which are defined by the position of the blocks with respect to one another in a given configuration. While providing a novel block playground system, the Schillig device is limited to the block module geometry, the number and position of each block. The blocks are repositionable with respect to one another, but fail to provide a means to completely reconfiguration a playground assembly or easily move and replace components.

The cited patents represents the most relevant devices currently disclosed in the prior art. It is submitted that the present invention provides a new and novel means of providing a modular playground assembly, wherein the position of each playground module is repositionable, replaceable and can be configured to a specific community's or user's preferences. A plurality of playground modules may be organized and positioned to create an entire park or playground layout. Playground architectures and methods of constructing similar parks fail to contemplate the disclosed foundation. The present invention is therefore substantially divergent in design elements from the prior art, consequently it is clear that there is a need in the art for an improvement to existing playground structures, foundations and methods of construction. In this regard the instant invention substantially fulfills these needs.

SUMMARY OF THE INVENTION

In view of the foregoing disadvantages inherent in the known types of playground structures and methods of construction now present in the prior art, the present invention provides a new playground structure, foundation and method of construction wherein the same can be utilized for providing convenience for the user when building and configuring a playground layout to suit a given need in either a short-term or long-term period.

It is therefore an object of the present invention to provide a new and improved playground foundation and method of construction that has all of the advantages of the prior art and none of the disadvantages.

Another object of the present invention is to provide a modular playground foundation wherein playground structures are modules that may be positioned in any desired configuration within a grid foundation layout and easily reconfigured or repositioned when desired.

Another object of the present invention is to provide playground foundation that employs a grid layout of playground module support locations for placement therein or thereon in a plurality of positions within the grid without modification to the foundation or the module itself.

Yet another object of the present invention is to provide a playground foundation that provides easy removal or placement of a playground module within the playground grid foundation, requiring little to no tools, no excavation and little time or expense.

Another object of the present invention is to provide a short-term playground foundation, wherein a playground layout may be setup and ready for use in a short amount of time and without permanent fixturing to allow the playground to be deconstructed after use without changing the environment or leaving any residual effects therein.

Another object of the present invention is to provide a long-term playground foundation, wherein a playground layout is setup in a permanent or semi-permanent grid foundation that allows playground structures to be repositioned and modular within the grid over an extended period of time.

A final object of the present invention is to provide a method of constructing or deploying a playground park using a predefined grid foundation, and one that may be temporarily deployed or permanently erected while still providing modular placement of playground structures thereon over its lifetime.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
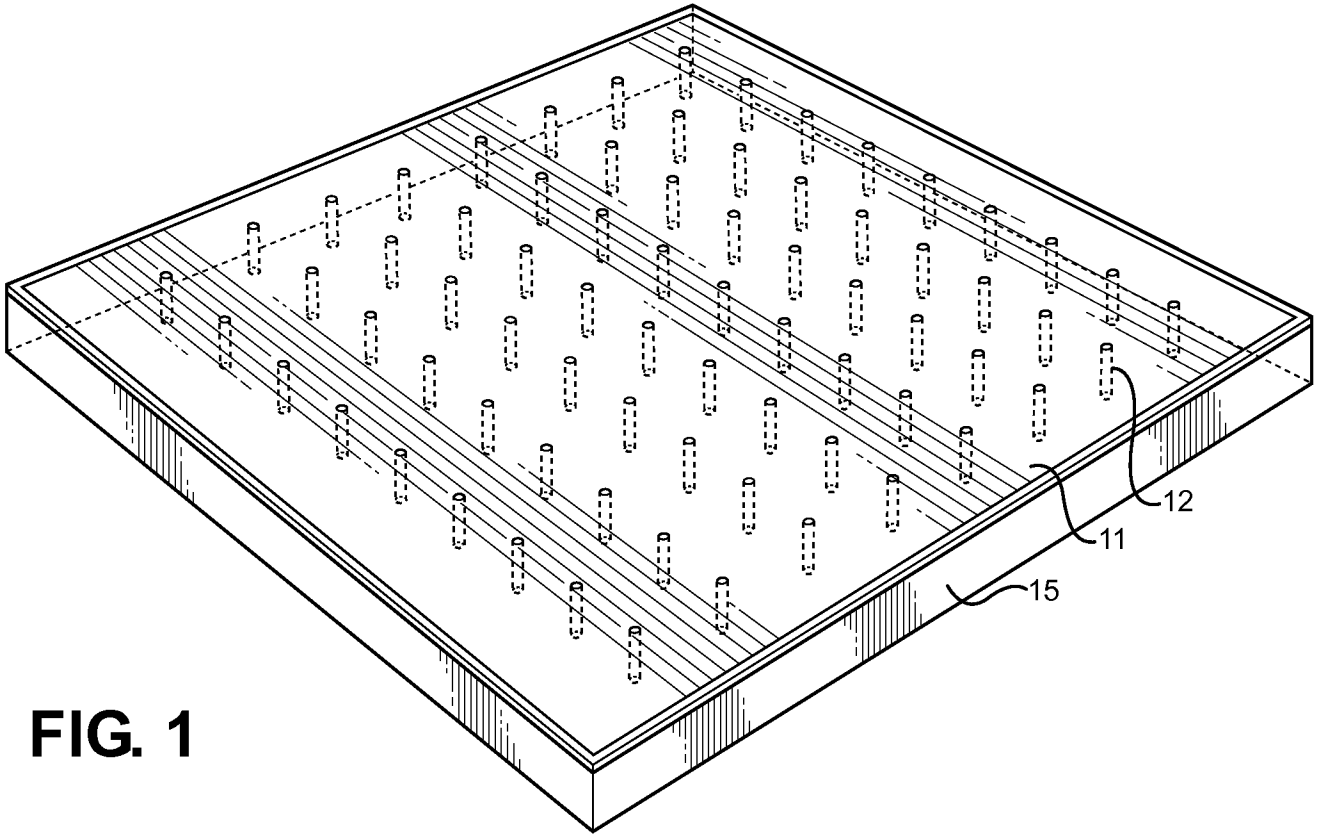
FIG. 1 shows an overhead perspective view of the grid foundation of the present invention in a long-term embodiment.

Reference is made herein to the attached drawings. Like reference numerals are used throughout the drawings to depict like or similar elements of the playground foundation and method of erecting a playground park. For the purposes of presenting a brief and clear description of the present invention, the preferred embodiment will be discussed as used for providing a modular playground architecture and method of construction. The figures are intended for representative purposes only and should not be considered to be limiting in any respect.

Referring now to FIG. 1, there is shown an overhead perspective of an embodiment of the grid foundation of the present invention. In this embodiment, the foundation comprises a plurality of playground structure support locations 12 along a planar surface having a thickness 15 and an upper surface 11. The grid foundation is a defined pattern or layout of support locations 12 for which to secure the structural supports of playground modules or similar structures that are desired for the given playground design. The grid of supports 12 is provided in an array to allow designers and users to choose a particular layout of playground modules to place along the foundation upper surface 11. The modules engage the support locations 12 and are supported thereby, preventing movement and promoting a static support during use. The contemplated modules for use include any structure or device that may be found in a typical playground or recreation park, including swing sets, jungle gyms, slides, castle structures, gazebos, benches and other similar structures one may desire in such a setting. The common factor between the modules includes structural support members that are adapted to conform to the disclosed grid foundation, wherein their location along the foundation upper surface 11 is accommodated by a plurality of support locations 12 working in harmony to secure the structure in place. In this way, an infinite combination of modules may be utilized simultaneously on the grid with positions dependent upon user demands and preferences. The support locations comprise uniform construction and are provided in a uniform pattern such that the modules are positionable anywhere on the foundation grid.

In a particular embodiment, wherein permanent or near-permanent positioning of the playground is desired, the foundation comprises a structure having a thickness that accommodates a plurality of support sleeves in a grid pattern. The foundation itself may be buried within the ground or raised thereabove, while its upper surface may take several forms: including a planar surface, a segmented surface or an undulating surface for creating surface contours upon which the modules are placed. The sleeve embodiment of the support locations 12 accepts a post of a playground module, wherein the two are concentrically aligned. A plurality of sleeves is engaged by a single module to affect a static support arrangement. A locking means may further prevent unwanted removal of the posts from the sleeves until desired.

Figure 2:
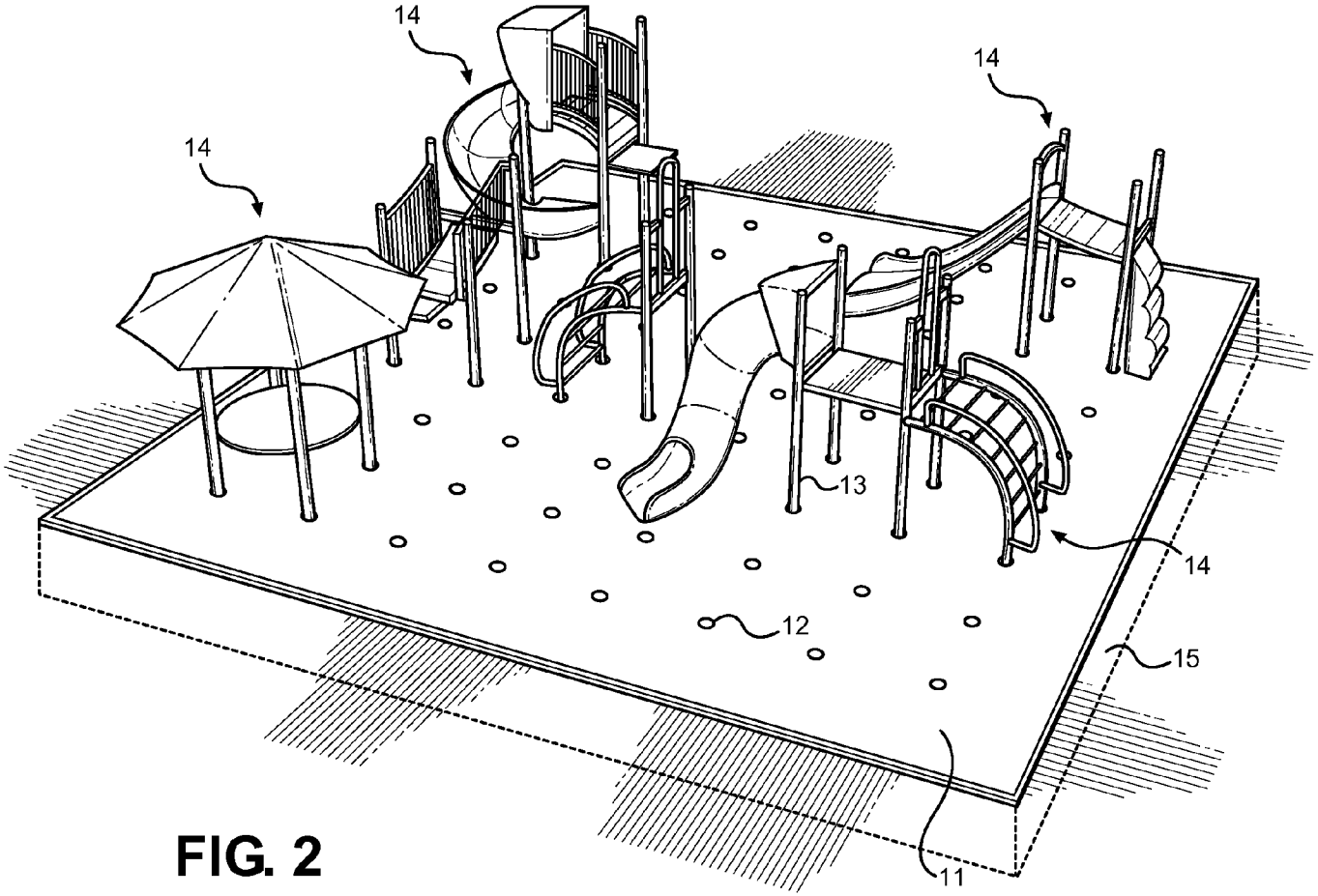
FIG. 2 shows an overhead perspective view of a configured and setup playground park utilizing the present grid foundation and method of construction.
Figure 5:
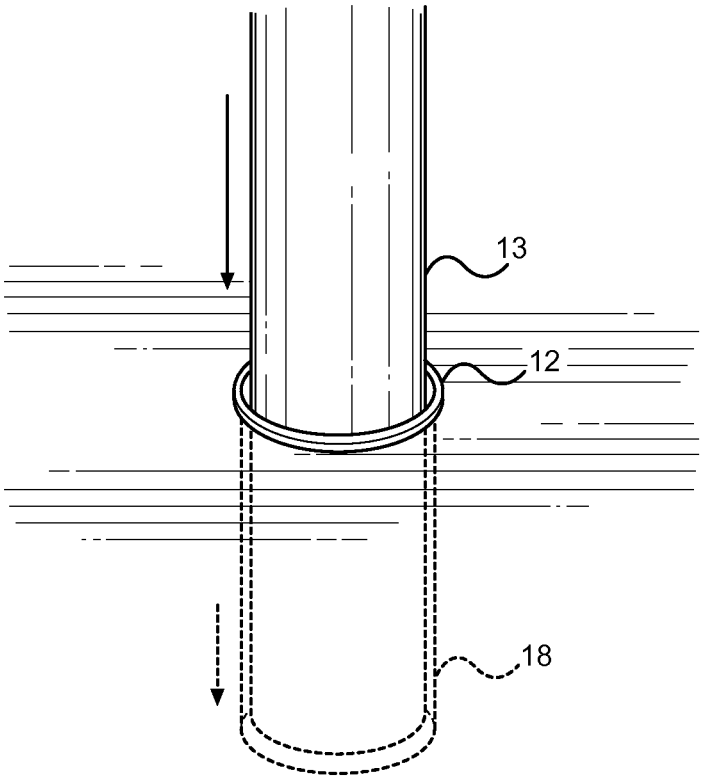
FIG. 5 shows an expanded view of the support post inserted of the present invention.

Referring now to FIGS. 2 & 5 there are shown an overhead perspective view of the disclosed grid foundation in a deployed position, wherein a plurality of playground modules 14 is positioned on the grid to form a working playground park. Each module comprises support posts or similar structural members 13 such that they engage and are supported by the grid support locations 12. The position, orientation and type of module are decided by the user, and may take any form desirable for the occasion, location or interests of the users. If the playground is intended for use by the public, the type of module and design should be designed within ASTM and nationally recognized playground standards and guidelines. The grid provides a predictable palette for a playground designer or user to create a playground park having a plurality of modules and recreational structures. In a particular embodiment, and illustrated in FIG. 2, the grid comprises a plurality of sleeve support locations 12 which act to secure the supports of each module. This embodiment contemplates utilization of a sleeve 18 for which the post 13 of a module support is positioned into to secure its location without permanent 'breaking ground' or utilization of excavation tools and permanent means of securement. The posts 13 slide into posts at a desired position, which place the module 14 in a particular quadrant of the grid and at a given orientation thereon with respect to the grid and the adjacent modules 14. The sleeves 18 and associated support locations 12 may take any geometric form to create a concentric or aligned fit with the posts 13, wherein minimal movement between the wall so the sleeves 18 and the post 13 is encountered while still permitting ease of insertion and removal. A locking means may further be provided to prevent unauthorized movement or tampering of the module supports, wherein the posts 13 are securely positioned in the sleeves 18 without fear of having a module repositioned or stolen when not under surveillance.

It is not desired to limit the physical size, shape and layout of the grid to a particular pattern or dimension, but rather to disclose a new means of constructing a playground using a grid layout that promotes modularity, ease of construction and ease of installation or removal. The grids are easy design constraints that allow the modules to be placed thereon with minimal expense, design work and with minimal tools. As shown in FIG. 2, the grid is provided in a permanent configuration, wherein the foundation is sufficiently large and optionally buried into the soil for configuration of a long-term or permanent playground park. This embodiment allows for a permanent foundation to be established, while still providing a means to update the playground over time as needs change, modules are damaged or rearrangement is desired. The foundation remains the same, while the modules may be replaced or reconfigured as necessary. The support locations may be protected when not in a working position and engaged with a playground module, which allows the support location to be preserved over time for future use. This protection may come in the form of a protective cover over a sleeve 18 or similar covering that prevents dirt and debris from entering the sleeve and prevents the sleeve from creating a trip hazard. The entire foundation may further be covered with mulch or soil after placement of the first playground configuration, in order to conceal the grid foundation presence. The protective covers further prevent excessive moisture or rain from entering the sleeves 18. This minimizes the possibility sleeve corrosion or the possibility of frozen water within the sleeves causing damage to the grid, which is a particular concern in colder climates. The sleeve covers are designed to accommodate different geographical regions with regard to these environmental concerns.

Figure 3:
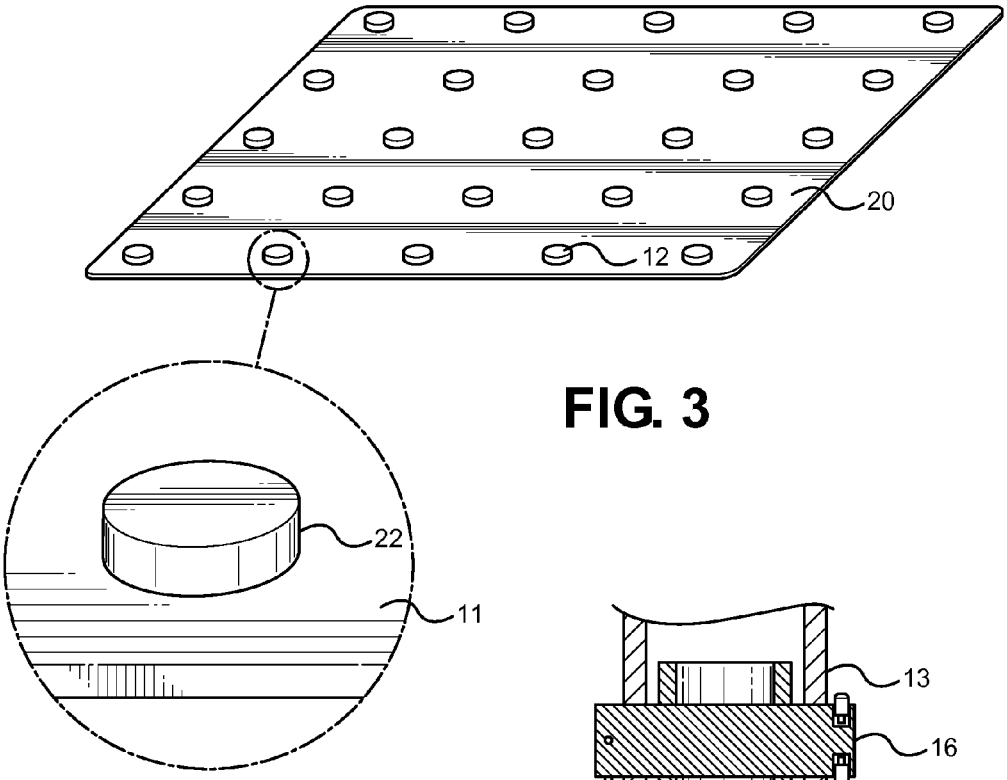
FIG. 3 shows an overhead perspective view of the grid foundation of the present invention in a quickly deployable and short-term embodiment.

In an alternate embodiment of the present invention, the grid foundation is provided in a temporary configuration for erecting and supporting a short-term playground park. In this embodiment, the grid foundation is deployable and is not permanently affixed to the ground surface, such that it may be utilized over a short time period to suit a desired function or activity wherein a plurality of playground structures and modules may be desired. Referring now to FIG. 3, there is shown an example of the short-term embodiment of the playground grid foundation, wherein a deployable mat 20 or surface having a plurality of support locations 12 thereon is provided. The mat 20 may be unrolled or otherwise deployed over an area, wherein the playground module support locations 12 are provided and the grid can be temporarily secured to the ground or simply positioned thereon. Once deployed, the chosen modules may be placed thereon as desired for creating a temporary support structure and playground park. This particular embodiment is useful for parties and other events where playground structures and devices may be desired without wanting to permanently affix the structures or travel to a location where a playground park already exists.

In a particular embodiment of the short-term grid, the support locations 12 may comprise strong permanent magnet discs 22 that provide strong securement of the playground module support posts such that they are statically supported while in use. Further embodiments include upstanding sleeves or thickened mats 20 having imbedded sleeves therein. Any structural support deemed adequate by one skilled in the art of playground structure installation may be utilized as a structural support location along the grid, falling within the scope of the present disclosure and spirit thereof.

Figure 4:
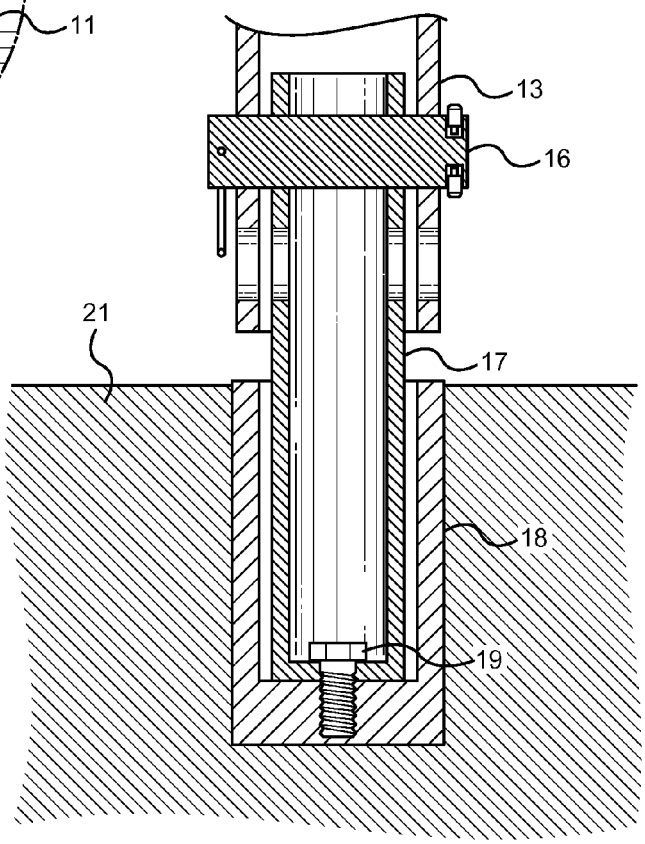
FIG. 4 shows a cross section view of an embodiment of the grid module securement means, wherein a post and sleeve is provided in a locked position.

Referring now to FIG. 4, there is shown an exemplary embodiment of an engagement between a support location and playground support structure. In this embodiment, the support structure 13 is locked or pinned 16 into a support location, wherein an upstanding post 17 is secured into the support location sleeve 18. The upstanding post is secured into the sleeve 18 using a securement means, such as a fastener 19 or spring locking mechanism, whereafter the post 17 body protrudes above the grid foundation 21 and engages a playground module support 13. The module support 13 is then pinned 16 or otherwise secured or locked into position on the post 17 such that the assembly is secured and prevented from unauthorized deconstruction or tampering. The elements of this embodiment are merely an illustrative example of such a connection between the disclosed playground modules and the disclosed grid foundation support locations. The supports of the modules may engage the grid without extra post elements, directly inserted into the sleeve, or a sleeve may be integrated into the grid via an upstanding sleeve adapted to secure the post of a module. It is desired to disclose a new and modular grid foundation for a playground that permits securement of playground modules in a lockable and secure manner, such that the modules can be arranged as desired, but are also securable to prevent theft or vandalism. It is further a desire to disclose the grid foundation in both a short-term and long-term embodiments, wherein the present device may be deployed for permanent use or for temporarily support of playground modules for enjoyment thereof and at the design of a user. The design of the support location may further provide for height adjustment of the individual module supports, wherein the module may be leveled and its height controlled by changing the position of a module post within the support location.

Associated with the disclosed grid foundation device is a new method of deploying and constructing a playground park, wherein the elements of the modular grid foundation are utilized. The method comprises utilizing a predefined foundation having a grid pattern of structural support locations to place a plurality of structures, playground modules or similar devices in a desired pattern to suit a particular need. The structures engage the grid support locations such that they are statically supported during use and optionally locked into position. The deployed foundation may be a short-term configuration or long-term configuration, wherein the structures are temporarily or permanently supported via the foundation. This method provides a new and convenient means of erecting a playground park or similar plurality of structures using predefined support locations. The support locations eliminate the need to excavate or fabricate a permanent or temporary support for the structure positioned on the foundation. This eliminates time, expense and ability with regard to designing and constructing the playground park.

The disclosed foundation method and apparatus is designed to provide several advancements in the art that facilitate the rapid deployment and ease of construction of playground parks or similar parks using the disclosed grid pattern. It is contemplated that a simple computer program may be utilized to aid users choosing specific modules to design an ideal park using the disclosed grid. The location of the modules may be altered, their orientation and the types of modules utilized. Companies and designers can utilize customer feedback by showing mock-ups of a proposed design, while a parent may utilize the program to allow a child to have input on the design process.

The modular nature of the present invention provides a means for a community or individual owner to make annual improvements or changes to the park with minimal expense or need for further construction. The elements of the park are modular and therefore easily replaceable or rearrangeable to lock in a lifetime of possibilities with regard the playground design and keep user's interest with regard to the park's use and design. The design of a park utilizing the permanently secured foundation embodiment may further be adapted for specific occasions or events, wherein the structures may be changed out or adapted to conform to a specific event, holiday or celebration, all without construction costs or breaking any new ground. The entire reconstruction and replacement is conducted within the existing grid foundation, wherein transportation of the modules or assembly at the foundation location is all that is required to erect the new structure and remove any existing structures.

One possible use that is envisioned through use of the present invention is to provide a revolving series of parks, wherein modules may be swapped between neighborhoods to share different modules and playground apparatuses. In this way, a new approach, "frugal newness" is provided, wherein parts are recycled and parks can be rejuvenated using existing materials. The modules may be repaired, cleaned and rotated between sites to provide new additions, capabilities and updated structures without the considerable cost that would otherwise be required for such a venture. The modules are adapted to be easily moved using no heavy machinery, wherein the modules may be separated from the grid with simple hand tools, deconstructed and moved or replaced. If desired, an entire module may be lifted from the grid in its working state using a jack or lift mechanism and repositioned.

Overall, the present invention provides a new and improved means of constructing a playground structure. The present apparatus and method provides for reduced construction costs, allows for a modular setup of a plurality of modules and can accommodate short-term and long-term configurations. It is therefore submitted that the instant invention has been shown and described in what is considered to be the most practical and preferred embodiments. It is recognized, however, that departures may be made within the scope of the invention and that obvious modifications will occur to a person skilled in the art.

With respect to the above description then, it is to be realized that the optimum dimensional relationships for the parts and steps of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A modular support system for structures, comprising:

a foundation having an upper surface and one or more perimeter walls extending downward from a perimeter edge of said upper surface and defining an interior volume, and a plurality of support locations aligned in a grid pattern, and extending downward from said upper surface;

a plurality of playground modules, wherein each of said plurality of playground modules has a plurality of structural supports extending therefrom;

wherein said plurality of support locations are adapted to engage with said plurality of structural supports;

wherein said plurality of support locations are adapted to support said plurality of playground modules in a static position;

said plurality of support locations being of uniform construction;

wherein said plurality of playground modules are interchangeably positionable at any location on said grid pattern at which each of said plurality of structural supports of said plurality of playground modules engages with one of said plurality of support locations.

2. The device of claim 1, wherein said plurality of support locations further comprise a locking means to secure said plurality of structural supports of each of said plurality of the playground modules and prevent unauthorized tampering.

3. The device of claim 1, wherein said plurality of structural supports of each of said plurality of playground modules further comprise posts and said plurality of support locations further comprise elongated sleeves to accept the posts of said plurality of structural supports of each of the plurality of the playground modules.

4. The device of claim 1, wherein said plurality of structural supports of each of said plurality of playground modules further comprise upstanding posts and said support locations further comprise elongated sleeves to accept the upstanding posts, said upstanding posts being fastened to said plurality of structural supports of each of the plurality of the playground modules.

5. The device of claim 1, wherein said plurality of support locations further comprise permanent magnets that affix to said plurality of structural supports of each of the plurality of the playground modules.

6. The device of claim 1, wherein said plurality of support locations further comprise upstanding posts to accept said plurality of structural supports of each of the plurality of the playground modules.

7. The device of claim 1, wherein said foundation further comprises a planar upper surface.

8. The device of claim 1, wherein said foundation further comprises a segmented upper surface.

9. The device of claim 1, wherein said plurality of support locations provide height adjustment for said plurality of structural supports of each of the plurality of the playground modules.

10. The device of claim 1, wherein said plurality of playground modules are selected from the group consisting of swing sets, jungle gyms, slides, castle structures, gazebos, and benches.

11. The device of claim 1, wherein said grid pattern of said plurality of support locations is a rectangular grid.

12. A temporary modular support system for structures, comprising:

a flexible foundation mat capable of being rolled and having an upper surface and one or more perimeter walls and a bottom surface, and a plurality of support locations aligned in a grid pattern along said upper surface;

a plurality of playground modules, wherein each of said plurality of playground modules has a plurality of structural supports extending therefrom;

wherein said plurality of support locations are adapted to engage with said plurality of structural supports;

wherein said plurality of support locations are adapted to support said plurality of playground modules in a static position;

said support locations being of uniform construction;

wherein said plurality of playground modules are interchangeably positionable at any location on said grid pattern at which each of said plurality of structural supports of the playground modules engages with one of said plurality of support locations.

13. The device of claim 12, wherein said plurality of support locations comprise magnets.

14. The device of claim 12, wherein said plurality of playground modules are selected from the group consisting of swing sets, jungle gyms, slides, castle structures, gazebos, and benches.

15. The device of claim 12, wherein said grid pattern of said plurality of support locations is a rectangular grid.

* * * * *